US005399212A

United States Patent [19]

Chakrabarti et al.

[11] Patent Number: 5,399,212

[45] Date of Patent: Mar. 21, 1995

[54] HIGH STRENGTH TITANIUM-ALUMINUM ALLOY HAVING IMPROVED FATIGUE CRACK GROWTH RESISTANCE

[75] Inventors: Amiya K. Chakrabarti, Monroeville, Pa.; George W. Kuhlman; Kristen A. Rohde, both of Cleveland, Ohio

[73] Assignee: Aluminum Company of America, Pittsburgh, Pa.

[21] Appl. No.: 873,298

[22] Filed: Apr. 23, 1992

[51] Int. Cl.[6] ..... C22C 14/00

[52] U.S. Cl. ..... 148/421; 148/670; 148/671

[58] Field of Search ..... 148/421, 670, 671

[56] References Cited

U.S. PATENT DOCUMENTS

| | | | |
|---|---|---|---|
| 4,053,330 | 10/1977 | Henricks et al. | 148/671 |
| 4,309,226 | 1/1982 | Chen | 148/421 |
| 5,026,520 | 6/1991 | Bhowal et al. | 148/670 |
| 5,173,134 | 12/1992 | Chakrabarti et al. | 148/671 |
| 8,867,208 | 2/1975 | Grekov et al. | 148/671 |

OTHER PUBLICATIONS

Titanium and Titanium Alloys, edited by M. J. Donachie, Jr., Am. Soc. for Metals, Metals Park, Ohio 44073, 1982, pp. 12, 308, 152–155.

Titanium Alloy Data Sheet, A. K. Chakrabarti, compiled from various reports and papers.

S. R. Seagle et al., "Development of a Deep Hardenable Alloy for Intermediate Temperature Application," RMI Company, Niles, Ohio, TMS Proceedings . . . .

L. J. Bartlo et al., "Deep Hardenable Titanium Alloy," Technical Report AFML-TR-73-122, AFSC, Wright-Patterson Air Force Base, Ohio, 1973, May.

R. A. Wood, "Titanium and Titanium Alloys-A Review of Selected Developments," Battelle Columbus Labs, 505 King Avenue, Columbus, Ohio 43201, May 26, 1972.

"Mechanical Property Data-Ti-6-22-22S Alloy, Solution Treated and Aged Plate," F33615-72-C-1280, Battelle Columbus Labs, 505 King Avenue, Columbus, Ohio 43201, Apr. 1973.

"Mechanical Property Data-Ti-6-22-22S Alloy, Duplex Annealed Forged Billet," F33615-73-C-5073, Battelle Columbus Labs, 505 King Avenue, Columbus, Ohio 43201, Apr. 1973.

C. G. Rhodes and J. C. Williams, "The Precipitation of $\alpha$-Phase in Metastable $\beta$-Phase Titanium Alloys," Met. Trans. A, vol. 6A, Nov. 1975, pp. 2103–2114.

D. Sundaramam et al., "Phase Transformations in Ti-6-a/o Fe and Ti-6 a/o Fe-1.5 a/o N Alloys," Trans. Indian Inst. of Metals, vol. 40, No. 3, Jun. 1987, pp. 249–256.

*Primary Examiner*—Upendra Roy

*Attorney, Agent, or Firm*—Douglas P. Mueller; Daniel A. Sullivan, Jr.; Gary P. Topolosky

[57] ABSTRACT

An alpha/beta titanium alloy having improved fatigue crack growth resistance can be prepared through a thermomechanical process using a three-step thermal treatment. The first step includes a heat up and hold at a temperature above the beta transition temperature, while the second step is a stabilization treatment which includes a heat up and hold below the beta transition temperature, in the alpha/beta range. The third thermal treatment is an aging treatment. The invention is particularly useful in preparing forged parts for aircraft.

10 Claims, 1 Drawing Sheet

HIGH STRENGTH TITANIUM-ALUMINUM ALLOY HAVING IMPROVED FATIGUE CRACK GROWTH RESISTANCE

BACKGROUND OF THE INVENTION

The present invention is directed to the production of a high durability titanium alloy useful for producing structural components for aircraft. Particularly, the present invention is directed to permitting significant weight reduction for fracture-sensitive aircraft components, particularly for high-performance aircraft, through the use of a highly fracture-resistant, high strength to density ratio titanium alloy. The high fracture resistance permits a damage-tolerant design approach. The high strength to density ratio will provide weight savings, with improved thrust to weight ratio and specific fuel consumption, with readily apparent benefits for takeoffs and landings and in aircraft flight range.

One alloy which has been widely used for structural aircraft application is a Ti-6Al-4V alloy. However, this alloy has not been completely satisfactory, particularly with respect to tensile strength. A possible replacement for the Ti-6Al-4V alloy is a titanium alloy containing (in weight percent) 6% Al, 2% Sn, 2% Zr, 2% Mo, 2% Cr and 0.23% Si (Ti-6-22-22S), which has good tensile strength. However, this alloy Ti-6-22-22S, under conventional alpha/beta processing conditions, generally has a disadvantage of low fatigue crack growth resistance. It is therefore an object of the present invention to improve the fatigue crack growth resistance of titanium alloys containing Al, Sn, Zr, Mo, Cr and Si.

Heat treatment of titanium alloys, such as annealing, solution treating and aging, may affect various properties of the alloy. Titanium alloys have a microstructure which includes a close-packed hexagonal structure (the alpha phase), which may change to a body-centered cubic structure (the beta phase) at a temperature known as the beta transition temperature or $T_\beta$. The beta transition temperature for any given alloy is easily determined experimentally.

Some alloying agents are alpha stabilizers, and raise the beta transition temperature. Oxygen and aluminum are examples of alpha stabilizers. Other alloying agents, such as manganese, chromium, iron, molybdenum, vanadium and niobium, lower the beta transition temperature, and may result in retention of some beta phase at room temperature. Other alloying elements, such as zirconium and tin, have relatively little effect on the beta transition temperature. Some titanium alloys are two-phase alloys containing both alpha and beta phases at room temperatures. While the two-phase alloys are the most versatile of the titanium alloys, different heat treatments will be applied to different alloys for different purposes.

SUMMARY OF THE INVENTION

The invention is directed to a process which improves the properties of alpha/beta titanium alloys. The alloy is processed using standard multiple step alpha/-beta forging, followed by a two-step beta-solution and alpha/beta stabilization treatment, followed by standard aging. The present invention also provides forged parts of an alpha/beta titanium alloy, such as an alloy having aluminum, tin, zirconium, molybdenum, chromium and silicon as alloying agents, having high strength and fracture toughness, along with superior fatigue crack growth resistance, which is at least equal to that of beta-annealed Ti-6Al-4V alloy. The alloy has a microstructure in which an acicular transformed beta phase is present in an aged beta matrix, possibly with second generation, very fine alpha phase within the aged beta matrix and at the interface of the acicular beta phase and the beta matrix.

DETAILED DESCRIPTION OF THE INVENTION

Figure 1A:
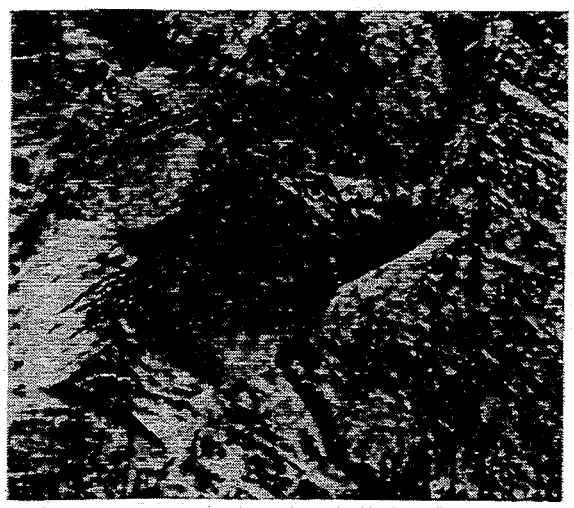
FIGS. 1A–C are 100×photomicrographs of a titanium alloy pancake forging according to the present invention, taken near the center, the surface and the edge respectively of the forging.

The present invention provides a low density, high strength titanium alloy having high fracture toughness and high fatigue crack growth resistance. The present invention is directed to alpha/beta titanium alloys, for example, alloys which include Al, Sn, Zr, Mo, Cr and Si as alloying agents, particularly the Ti-6-22-22S alloy. More specifically, the alloy may have the following composition (amounts expressed in weight percent): Al-5.25 to 6.25; Sn-1.75 to 2.25; Zr-1.75 to 2.25; Mo-1.75 to 2.25; Cr-1.75 to 2.25; Si-0.20 to 0.27; Fe-0 to 0.15; O-0 to 0.13; C-0 to 0.04; N-0 to 0.03; H-0 to 0.0125; residual elements-0 to 0.10 each, no more than 0.30 total, remainder titanium. The presence of oxygen in the upper amount of the range recited above can provide increased strength, but amounts above the upper limit may have a serious effect on toughness.

The alloy of the present invention may be used in the production of forged parts, particularly thick section forgings such as aircraft bulkheads, wing carry-through structure, landing gear supports and the like. While Ti-6Al-4V alloy, beta annealed, may meet the requirements for such forgings with respect to fracture toughness and fatigue crack growth rate, this alloy does not provide adequate tensile strength. The alloys of the present invention have a fatigue crack growth rate performance at least equal to that of beta-annealed Ti-6Al-4V alloy, with improved tensile strength.

Along with a fatigue crack growth resistance at least equal to that of beta-annealed Ti-6Al-4V, the alloys of the present invention show a tensile yield strength of at least 135 ksi (kilopounds per square inch), preferably at least 145–150 ksi. The alloy will show an ultimate strength of at least 150 ksi, preferably at least 160. The alloy will show a fracture toughness of at least about 70 ksi.in$^{\frac{1}{2}}$, preferably at least 80 ksi.in$^{\frac{1}{2}}$. The alloy should have an elongation at fracture of at least 6%, preferably 10%, and a reduction in area at fracture of at least 10%, preferably 15%. The beta-annealed Ti-6Al-4V alloy shows a fatigue crack growth rate of $2.5\times10^{-6}$ in/cycle at an applied stress intensity of 20 ksi.in.$^{\frac{1}{2}}$ and the present alloys have a rate which is comparable or lower, e.g. about $2\times10^{-6}$in/cycle at an applied stress of 20 ksi.in$^{\frac{1}{2}}$.

The beta transition temperature ($T_\beta$) for titanium alloys is the temperature at the line on the phase diagram for the alloy separating the wholly beta-phase field from the alpha/beta region where alpha and beta phases coexist. $T_\beta$ for a given composition may be determined by holding a series of specimens at different temperatures for one hour, followed by quenching in water. The microstructures of the specimens are then examined, with those held at temperatures below $T_\beta$ showing alpha and beta phases, while those held above $T_\beta$ will show a transformed beta structure. The beta transition temperature for Ti-6-22-22S alloys of the present invention is about 1735° F., ±10°.

The process of preparing forged parts according to the present invention will now be described. First, billet stock is subjected to a series of forging operations, which may include preform and finish forging steps. The forging steps are to include sufficient alpha/beta working such that recrystallization will occur during the first stage of the heat treatment, resulting in a more uniformproduct. A total reduction of at least about 1.4:1, preferably at least 3:1, is used. All forging operations are carried out at temperatures in the alpha/beta range, for example about 1625° to 1675° F., i.e., about $T_\beta$ −50° F. to −75° F., in the case of Ti-6-22-22S. The forging processes can be carried out with a heated die, for example, one heated at about 800° F.

The forging is followed by a three-step thermal treatment, including solution treatment, stabilization and aging. The forged part can be subjected to cooling, e.g. fan, still air or oil or water quenching, after the solution treatment and stabilization. The solution treatment step is a heat treatment above the beta transition temperature, for example, about 30° F. to 75° F. above the beta transition temperature, i.e., about 1785° F. to 1810° F. in the case of the Ti-6-22-22S alloy. The solution treatment is carried out for about one-half hour or so at temperature. The part is then subjected to cooling, preferably fan air cooling, although still air cooling or oil or water quenching may also be employed, depending on part geometries and section sizes. The part is then subjected to a second, alpha/beta stabilization treatment, for example at a temperature of about 30° F. to 90° F. below the beta transition temperature, i.e., about 1645° F. to 1685° F. in the case of the Ti-6-22-22S alloy. This is carried out for about one hour at temperature, i.e., about 45 min. to 2 hours. These and other heating steps may be carried out in a vacuum furnace or under an inert atmosphere if necessary to prevent undesirable absorption of oxygen or nitrogen by the alloy. The part is then subjected to cooling, preferably still air cooling, although fan air cooling or oil or water quenching may be employed.

The solution treatment and stabilization are followed by a suitable aging step. The part may be air cooled prior to the aging step. Suitable aging conditions may be a temperature of about 900° F. to 1050° F. for a time of 6 to 10 hours, preferably about 8 hours. The aging again is followed by cooling, preferably still air cooling.

The beta solution treatment serves to put all of the alpha phase present into solution and homogenizes the composition. The subsequent fast cooling develops a Widmanstatten transformed beta-type microstructure. The stabilization treatment may thicken the transformed beta plates. In addition, it may lead to development of second generation alpha at the transformed beta-aged beta interfaces, and creates a more stable interface. The cooling from stabilization creates a supersaturation of alpha-stabilizers, and the aging step produces a very fine second generation alpha in the retained beta matrix.

EXAMPLE

Three-inch diameter bar stock was used in the work described below. The chemical composition was as follows: Al-6.0%; Sn-2.2%; Zr-1.8%; Cr-2.1%; Mo-1.9%; Si-0.16%; O-0.076%; N-0.01%; C-0.02%; Fe-0.06%; H-70 ppm.

The three-inch diameter bar stock was forged to a 1.75 inch thick pancake having a 6-inch diameter and then heat treated. Treatment conditions are shown in the following table, along with the tensile properties and fracture toughness.

TABLE 1

Mechanical Property of the Ti-6-22-22S Pancake Forgings

| Comparative Examples | Prior Treatment | Preform Forging | Finish Forging | Heat Treatments | Tensile Properties TYS (ksi) | UTS (ksi) | % EL | % RA | Fract. Toughness $K_{Ic}$ (ksi $\sqrt{\text{in.}}$) |
|---|---|---|---|---|---|---|---|---|---|
| 1 | None | αβ at 1675° F. | β-finish at 1790° F. | 1690° F./1, FAC + 1000° F./8, AC | 143 | 161 | 12 | 22 | 82.3 V |
| | | | | | 144 | 161 | 10 | 18 | |
| | | | | | 145 | 162 | 10 | 22 | |
| 2 | None | αβ at 1675° F. | β-finish at 1790° F. | 1640° F./1, FAC + 1000° F./8, AC | 140 | 155 | 12 | 23 | 74.9 V |
| | | | | | 142 | 160 | 10 | 21 | |
| | | | | | 143 | 159 | 14 | 20 | |
| 3 | None | αβ at 1675° F. | β-finish at 1825° F. | 1690° F./1, FAC + 1000° F./8, AC | 142 | 160 | 10 | 21 | 79.8 V |
| | | | | | 145 | 161 | 11 | 20 | |
| | | | | | 148 | 165 | 15 | 21 | |
| 4 | αβ-upset + Redraw (300/0) | β-preform at 1790° F. | αβ-finish (50%) | 1690° F./1, FAC + 1000° F./8, AC | 148 | 161 | 12 | 22 | 53.2 V |
| | | | | | 147 | 162 | 12 | 22 | |
| | | | | | 154 | 164 | 12 | 32 | |
| 5 | αβ-upset + Redraw (300/0) | β-preform at 1790° F. | αβ-finish (25%) | 1690° F./1, FAC + 1000° F./8, AC | 147 | 160 | 11 | 23 | 61.61 V |
| | | | | | 150 | 163 | 12 | 23 | |
| | | | | | 150 | 163 | 12 | 29 | |
| 6 | αβ-upset + Redraw (300/0) | β-preform | β-finish (50%) | 1690° F./1, FAC + 1000° F./8, AC | 145 | 162 | 9 | 13 | 74.11 V |
| | | | | | 146 | 163 | 10 | 15 | |
| | | | | | 147 | 163 | 12 | 18 | |
| 7 | None | αβ-preform (50%) | αβ-finish (50%) | 1785° F./1/2 FAC + 1000° F./8, AC | 137 | 159 | 11 | 18 | 68.4 V |
| | | | | | 139 | 161 | 10 | 18 | |
| | | | | | 140 | 162 | 10 | 9 | |
| Example 1 | None | αβ-preform (50%) | αβ-finish (50%) | 1785° F./1/2 FAC + 1640° F./1, AC + 1000/8, AC | 139 | 159 | 10 | 19 | 77.5 V |
| | | | | | 141 | 159 | 11 | 18 | |
| | | | | | 141 | 158 | 10 | 15 | |

It can be seen that Comparative Examples 1–3 involve alpha/beta preform forging, beta finish forging and a one-step solution treatment followed by aging. Comparative Examples 4 and 5 each involved beta preform forging, alpha/beta finish forging and a one-step alpha/beta solution treatment followed by aging. Comparative Example 6 involved beta-preform forging, beta-finish forging and a one-step alpha/beta solution treatment followed by aging. Comparative Example 7 involved alpha/beta preform forging, alpha/beta finish forging and a one-step beta solution treatment followed by aging.

Figure 1B:
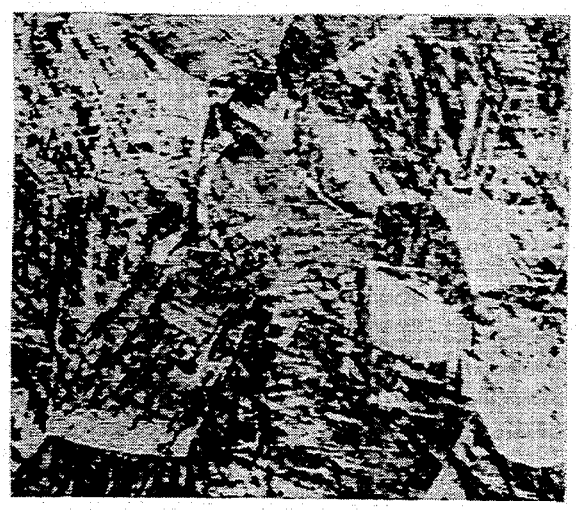
Figure 1C:
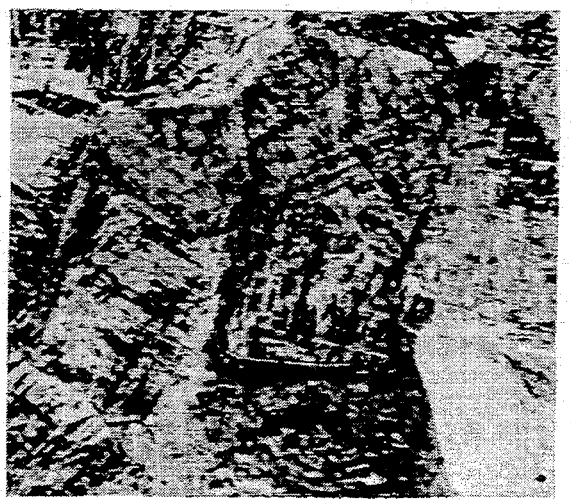

FIGS. 1A–C represent 100×magnification photomicrographs of a specimen of Example 1. It can be seen that the material had a microstructure formed of acicular transformed beta phase (Widmanstatten type) in an aged beta matrix. Thus, while Comparative Example 7 and Example 1 both show acicular transformed beta in an aged beta matrix as a microstructure, the formation of a more stable equilibrium interface structure may increase resistance to interface cracking and thus may be responsible for the difference in fracture toughness shown between Example 1 and Comparative Example 7.

Example 1 and Comparative Examples 1, 4 and 5 were subjected to fatigue crack growth resistance testing. Example 1 showed the best fatigue crack growth resistance, and was the only material which showed fatigue crack growth resistance equivalent to or better than that of beta-annealed Ti-6Al-4V alloy. Thus, while several of the comparative examples showed satisfactory results in tensile strength and toughness, only Example 1 was satisfactory in fatigue crack growth resistance.

The material of Example 1 was subjected to scanning electron microscope fractographic observation for the fractured surfaces. The entire fracture surface was found to have a rough appearance, particularly the fast fracture area where a coarse intergranular type of fracture was observed. The fatigue precrack area showed a relatively flat surface with some dimples and striated areas. The fatigue crack growth area exhibited a combination of fine dimples and striations. Upon examination at higher magnification, the fatigue precrack area exhibited a serrated and striated appearance, with the serrated appearance apparently due to the local orientation of the acicular transformed beta and the striated appearance due to the stepwise growth of the fatigue crack front. The fatigue crack growth area exhibited a mixed dimpled, serrated and striated appearance. The fast fracture area, which exhibited a flat-faceted appearance at the lower magnification, displayed a large number of small dimples at higher magnification. It appeared from the fractographic observations that the material of Example 1, with the acicular transformed beta microstructure, exhibited extensive secondary cracking along the grain boundaries and occasionally through the interfaces of the acicular transformed beta-aged beta matrix. The extensive grain boundary cracking and crack branching result in a high energy requirement for crack extension, resulting in increased fracture toughness and fatigue crack growth resistance.

While the present invention has been illustrated by numerous examples and described in detail above, obvious variations may occur to one of ordinary skill and thus the invention is intended to be limited only by the following claims.

What is claimed is:

1. A titanium alloy comprising Al, Sn, Zr, Mo, Cr and Si as alloying agents, having a tensile yield strength of at least about 135 ksi, an ultimate strength of at least about 150 ksi, a fracture toughness of at least about 70 ksi.in.$^{\frac{1}{2}}$ and a fatigue crack growth rate not more than about $2\times10^{-6}$in./cycle at an applied stress intensity of 20 ksi. in.$^{\frac{1}{2}}$ and having a microstructure comprising an acicular transformed beta phase in an aged beta matrix.

2. The alloy of claim 1, having the following composition expressed in weight percent: Al-5.25 to 6.25; Sn-1.75 to 2.25; Zr-1.75 to 2.25; Mo-1.75 to 2.25; Cr-1.75 to 2.25; Si-0.20 to 0.27; Fe-0 to 0.15; O-0 to 0.13; C-0 to 0.04; N-0 to 0.03; H-0 to 0.125; residual elements-0 to 0.10 each, no more than 0.30 total; remainder Ti.

3. A forged part formed of a titanium alloy comprising Al, Sn, Zr, Mo, Cr and Si as alloying agents, having a tensile yield strength of at least about 135 ksi, an ultimate strength of at least about 150 ksi, a fracture toughness of at least about 70 ksi.in$^{\frac{1}{2}}$ and a fatigue crack growth rate not more than about $2\times10^{-6}$in./cycle at an applied stress intensity of 20 ksi in.$^{\frac{1}{2}}$, and having a microstructure comprising an acicular transformed beta phase in an aged beta matrix.

4. The part of claim 3, which is formed by a process comprising alpha/beta preform forging and alpha/beta finish forging with a total reduction greater than 3:1; a beta solution treatment step; an alpha/beta stabilization treatment step; and aging.

5. The part of claim 4, wherein the part is subjected to cooling between the solution and stabilization treatment steps.

6. The part of claim 5, wherein the solution treatment is at a temperature about 30° F. to 75° F. above the beta transition temperature and the stabilization treatment step is at a temperature about 30° F. to 90° F. below the beta transition temperature.

7. The part of claim 6, wherein the time at temperature in the stabilization treatment step is longer than that in the solution treatment step.

8. The part of claim 6, wherein the aging step is carried out at about 900° F. to 1100° F.

9. A forged titanium alloy part, the alloy being an alpha/beta type titanium alloy, produced by a process which comprises the steps of: alpha/beta preform forging and alpha/beta finish forging with a total reduction greater than 3:1; a beta solution treatment step; an alpha/beta stabilization treatment step; and aging.

10. A forged part of an alpha/beta titanium alloy, produced by a process which comprises a beta solution treatment step, an alpha/beta stabilization treatment step and aging, wherein each of the solution and stabilization treatments is followed by cooling and the beta solution treatments puts alpha phase present in the part into solution, the cooling after the solution treatment results in a widmanstatten transformed beta-type microstructure, the stabilization treatment results in a stabilized equilibrium interface structure, the cooling after the stabilization treatment results in a supersaturation of alpha stabilizers and the aging produces a fine second generation alpha phase in a retained beta matrix.

* * * * *